US006250053B1

(12) United States Patent
Edström et al.

(10) Patent No.: US 6,250,053 B1
(45) **Date of Patent: *Jun. 26, 2001**

(54) METHOD AND DEVICE FOR APPLYING WRAPPING SHEETS ON PULP BALES

(75) Inventors: Tomas Edström, Ankarsvik; Göran Forhaugh; Age Jonsson, both of Sundsvall, all of (SE)

(73) Assignee: Valmet Fibertech Aktiebolag (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/015,564

(22) Filed: Jan. 29, 1998

(30) Foreign Application Priority Data

Jan. 31, 1997 (SE) ..... 9700305

(51) Int. Cl.[7] ..... B65B 3/26; B65B 11/00; B65B 11/58

(52) U.S. Cl. ..... 53/504; 53/466; 53/449

(58) Field of Search ..... 53/504, 580, 586, 53/399, 52, 220, 449, 466, 228, 230, 526; 493/478, 479

(56) References Cited

U.S. PATENT DOCUMENTS

| | | | | |
|---|---|---|---|---|
| 3,471,994 | | 10/1969 | Cranston, Jr. et al. . | |
| 3,511,014 | * | 5/1971 | Kochalski | 53/526 |
| 3,536,319 | | 10/1970 | Cranston, Jr. et al. . | |
| 3,559,362 | | 2/1971 | Cranston, Jr. et al. . | |
| 3,589,100 | * | 6/1971 | Konars et al. | 53/526 |
| 3,665,673 | * | 5/1972 | Billett et al. | 53/466 |
| 3,982,375 | | 9/1976 | Focke . | |
| 3,994,116 | * | 11/1976 | McCormick | 53/466 |
| 4,110,954 | * | 9/1978 | Olsson et al. | 53/526 |
| 4,167,841 | * | 9/1979 | Camp | 53/228 |
| 4,989,397 | * | 2/1991 | Tomac et al. | 53/586 |
| 5,225,495 | * | 10/1993 | Kovacs | 53/504 |
| 5,299,410 | * | 4/1994 | Freeman | 53/504 |
| 5,447,012 | * | 9/1995 | Kovacs et al. | 53/526 |
| 5,657,608 | | 8/1997 | Parviainen et al. . | |

FOREIGN PATENT DOCUMENTS

| | | |
|---|---|---|
| 1 511 682 | 7/1969 | (DE) . |
| 1 297 217 | 11/1972 | (GB) . |
| 2 233 954 | 1/1991 | (GB) . |

* cited by examiner

*Primary Examiner*—Brian L. Johnson
*Assistant Examiner*—Matthew Luby
(74) *Attorney, Agent, or Firm*—Lerner, David, Littenberg, Krumholz & Mentlik, LLP

(57) ABSTRACT

A method and apparatus for wrapping bales of pulp are disclosed, the method comprising transporting the bales between upper and lower conveyors, applying a first wrapping sheet to the lower surface of the bale, applying a second wrapping sheet to the upper surface of the bale, measuring the height of the bale prior to transporting it between the upper and lower conveyors, and adjusting the distance between the upper and lower conveyors based upon the measured height of the bale such that both of the wrapping sheets are uniformly disposed on the upper and lower surfaces of the bale. The apparatus includes an upper conveyor, a lower conveyor juxtaposed with the upper conveyor, such that the bales may be transported between the upper and lower conveyors, a transmitter for measuring the height of the bales upstream of the upper and lower conveyors, and a positioner for adjusting the distance between the upper and lower conveyors based on the measured height of the bales.

10 Claims, 1 Drawing Sheet

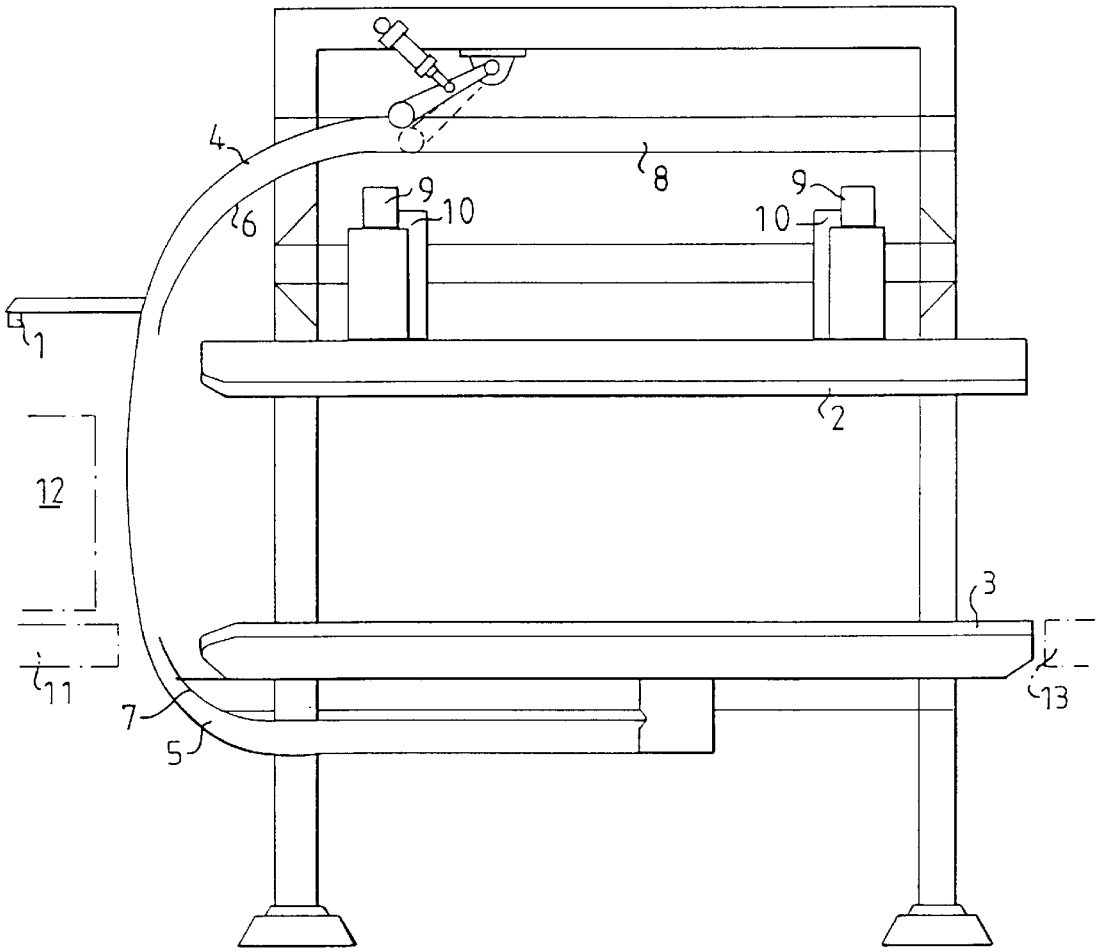
4
6
8
9
10
9
10
1
2
12
3
11
7
5
13

METHOD AND DEVICE FOR APPLYING WRAPPING SHEETS ON PULP BALES

FIELD OF THE INVENTION

The present invention relates to the applying of wrapping sheets to pulp bales in which wrapping sheets are applied on each pulp bale during its transport between at least one upper and at least one lower conveyor.

BACKGROUND OF THE INVENTION

During the wrapping of pulp bales by means of two wrapping sheets, precut sheets or rolls are presently used, from which the sheets are cut in connection with the wrapping process. One sheet is thus transported to a lower folding position in a lower sheet pocket, and the other sheet is transported to an upper folding position in an upper sheet pocket. The sheets are positioned in such a way that, when the pulp bale is transported by a conveying belt between an upper and a lower conveyor, it comes into contact with the two sheets, whereby one on the upper side and one on the lower side of the bale follow along with the bale between the conveyors.

The lower wrapping sheet is clamped between the bale and the lower conveyor and in this way follows along with the bale in between the conveyors.

The bale height, however, can vary. In order to nevertheless ensure that the upper wrapping sheet in this case is also clamped between the bale and the upper conveyor, this conveyor has been inclined in such a way that the distance between the upper and lower conveyor decreases along the direction of transport.

The upper conveyor has thus been made resilient in such a way that a sufficient contact force is obtained, and the upper wrapping sheet thus follows along with the bale when the sheet is clamped between the upper conveyor and bale. The force, however, must not be so great that the bale is rigidly clamped and obstructed with continued passage between the conveyors.

While the bale together with the applied wrapping sheets is transported between the upper and lower conveyors, the sides of the sheet parallel to the conveying direction are folded inward towards the bale, and thereafter the bale is transported to a folding machine by a conveyor.

The problem with the present technology is that the upper and lower wrapping sheets, when the folding process is to commence, can be offset in relation to each other in the conveying direction. This displacement varies with the bale height and, thus, differs from one bale to the next. The displacement of the wrapping sheets can thus create problems in subsequent folding machines.

In the case above, the upper conveyor is inclined and the bale height varies, the point where the bale comes into contact with the upper conveyor for clamping the wrapping sheet can vary considerably. As a result, the upper sheet is displaced in relation to the lower sheet, because the lower sheet is always clamped at the same distance from the edge of the wrapping paper, while the upper sheet is clamped at different distances from the edge of the wrapping paper, depending on how far into the machine the bale has been transported before the bale comes into contact with the conveyor.

Due to the inclination of the upper conveyor, the contact force ensuring that the wrapping sheet is clamped is directed in such a manner that the bale is subjected to shearing forces. This, too, results in displacement of the wrapping sheets.

Another reason for such sheet displacement is that the conveyors advance the bale with varying force.

SUMMARY OF THE INVENTION

In accordance with the present invention, these and other objects have now been realized by the invention of a method for wrapping bales of pulp comprising transporting the bales between an upper conveyor and a lower conveyor, applying a first wrapping sheet to the lower surface of the bale as it is transported along a lower conveyor, applying a second wrapping sheet to the upper surface of the bale as it is transported along the upper conveyor, measuring the height of the bale prior to transporting the bale between the upper and lower conveyors, and adjusting the distance between the upper and lower conveyors based upon the measured height of the bale, whereby the first and second wrapping sheets are uniformly disposed on the upper and lower surfaces of the bale.

In accordance with one embodiment of the method of the present invention, the method includes sensing changes in the height of the bale during transporting of the bale between the upper and lower conveyors, and adjusting the distance between the upper and lower conveyors based upon the changes in the height of the bales.

In accordance with another embodiment of the method of the present invention, applying the first wrapping sheet to the lower surface of the bales comprises applying the first wrapping sheet from a lower folding position, and applying the second wrapping sheet to the upper surface of the bales comprises applying the second wrapping sheet from an upper folding position. In a preferred embodiment, the adjusting of the distance between the upper and lower conveyors includes adjusting the upper folding position.

In accordance with another embodiment of the method of the present invention, the method includes synchronizing the speed of the upper and lower conveyors.

In accordance with the apparatus of the present invention, apparatus for wrapping bales of pulp have been discovered comprising an upper conveyor, a lower conveyor juxtaposed with the upper conveyor, whereby the bales can be transported between the upper and lower conveyors, a transmitter for measuring the height of the bales upstream of the upper and lower conveyors, and positioning means for adjusting the distance between the upper and lower conveyors based upon the measured height of the bales, whereby wrapping sheets may be uniformly disposed on the upper and lower surfaces of the bales as the bales are transported between the upper and lower conveyors.

In accordance with one embodiment of the apparatus of the present invention, the upper and lower conveyors are substantially parallel to each other.

In accordance with another embodiment of the apparatus of the present invention, the apparatus includes a sensor for measuring changes in the height of the bales while the bales are being transported between the upper and lower conveyors.

In accordance with another embodiment of the apparatus of the present invention, the apparatus includes an upper sheet pocket for providing a wrapping sheet to the upper surface of the bales and a lower sheet pocket for providing a wrapping sheet to the lower surface of the bales, the upper sheet pocket being connected to one of the upper and lower conveyors, whereby the upper sheet pocket is simultaneously adjusted with adjusting of the distance between the upper and lower conveyors.

In accordance with another embodiment of the apparatus of the present invention, the apparatus includes synchronizing means for synchronizing the speeds of the upper and lower conveyors.

According to the present invention, the above-mentioned problems are solved by means of the position of the upper conveyor being adjustable in the vertical direction by means of a positioning device. This adjustment is carried out on the basis of values from a transmitter, which measures the height of the bale in connection with the infeed of the bale between the upper and lower conveyors. The upper conveyor is positioned such that its position in relation to the bale in question is always the same. The two conveyors can thus be arranged substantially parallel to each other.

A sensing device is provided to sense the force arising on the upper conveyor when the bale is between the conveyors. The value measured by the sensing device adjusts the position of the upper conveyor by means of the positioning device, so that the force on the bale is changed to the desired level. Also, this can be obtained by not driving the upper conveyor.

The speeds of the upper and lower conveyors are also synchronized. This ensures that the driving force on the bale in the conveying direction is the same on the upper side and the lower sides of the bale.

The upper sheet pocket, and thus the upper sheet, can follow along with the movements of the upper conveyor. In this manner, an accurate placing of the upper and lower wrapping sheets in relation to each other is obtained.

The aforesaid measures result in a positioning of the wrapping sheets on the pulp bale which is advantageous for a subsequent folding machine. This is a result of the fact that the position of the upper wrapping sheet at its application on the bale can be controlled so that there is practically no displacement in the conveying direction in relation to the lower wrapping sheet, and that substantially no shearing forces, which can displace the sheets in relation to the bale, arise on the bale during the transport between the upper and lower conveyors.

Since the present invention results in placement of the wrapping sheets on the pulp bale in a substantially predetermined position, the size of the wrapping sheets can thus be optimized.

BRIEF DESCRIPTION OF THE DRAWING

The present invention may be more fully appreciated with reference to the following detailed description, which, in turn, refers to the Drawing which is a side, elevational view of an apparatus in accordance with the present invention.

DETAILED DESCRIPTION

The sheet application device shown in the Drawing comprises a transmitter 1, preferably an ultrasound sensor or analogous transmitter, for measuring the bale height, upper and lower conveyors, 2 and 3, upper and lower sheet pockets, 4 and 5, upper and lower folding positions, 6 and 7, for the sheets, and a waiting position 8 for the sheets. The apparatus further comprises a positioning device 9, for example a pneumatic alternatively hydraulic lifting device or a mechanical gear device driven by a motor, for the upper conveyor 2, and a sensing device 10 for the force acting on the upper conveyor 2. A conveying belt 11 is provided for feeding a pulp bale 12 to the sheet application device, and a conveying belt 13 is provided for discharging the bale.

From a stack of ready-cut wrapping sheets, one wrapping sheet is fed into the waiting position 8. The sheet is transported from the waiting position to a lower folding position in the lower sheet pocket 5. Another wrapping sheet is fed to the waiting position 8. This sheet is fed to an upper folding position in the upper sheet pocket 4. As soon as a wrapping sheet has been transported from the waiting position 8, the sheet is replaced by another one.

The wrapping sheets are placed in predetermined folding positions in the sheet pockets, 4 and 5. The sheets are placed in such a way that the upper sheet has a substantially free portion suspended downward from the upper sheet pocket 4, and the lower sheet has a substantially free portion standing upward from the lower sheet pocket 5. The free portions of the sheets are arranged so that they partially overlap each other.

A pulp bale 12 is transported by means of the conveying belt 11 towards upper and lower wrapping sheets as one on the upper and one on the underside of the pulp bale 12 follows along with it in between the upper and lower conveyors, 2 and 3, respectively.

Before the bale 12 comes into contact with the sheets, the height of the bale is measured by a transmitter 1. The value measured by the transmitter controls the position of the upper conveyor 2 in the vertical direction in relation to the lower conveyor 3 by means of the positioning device 9.

The upper conveyor 2 is positioned such that its position in relation to the bale in question is always the same. When the bale comes into contact with the upper and lower wrapping sheets, the lower sheet is clamped between the lower conveyor 3 and bale 12. The upper wrapping sheet is clamped between the bale 12 and upper conveyor 2. As the position of the conveyor in relation to the bale in question is always the same, the wrapping sheets are clamped in the same position in relation to the transport direction for each bale.

The upper conveyor 2 is substantially horizontal and substantially in parallel with the lower conveyor 3. The distance between the conveyors, and thus the contact force clamping the wrapping sheets against the bale, is thus substantially equally great during the entire transport through the device.

The speeds of the upper and lower conveyors, 2 and 3, are synchronized. This ensures that the driving force on the bale in the transport direction is the same on the upper and lower sides of the bale.

While the bale 12 together with the applied wrapping sheets is transported between the upper and lower conveyors, 2 and 3, the wrapping sheet sides in parallel with the transport direction are folded inward towards the bale.

If for some reason the bale stays in the position between the upper and lower conveyors for so long that the bale swells, the sensing device 10 senses the force, which arises against the upper conveyor 2. By means of the value measured by the sensing device 10, the positioning device 9 adjusts the position of the upper conveyor 2, so that the force on the bale is restored to the desired level.

The upper folding position 6, and thus the upper sheet, can follow along with the vertical adjusting movements of the upper conveyor 2. In this way an accurate placement of the upper and lower wrapping sheets in relation to each other is obtained.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of wrapping a plurality of bales of pulp having various heights comprising transporting each bale between an upper conveyor and a lower conveyor in a conveying direction, applying a first wrapping sheet to the lower surface of said bale as it is transported along said lower conveyor, applying a second wrapping sheet to the upper surface of said bale as it is transported along said upper conveyor, measuring the height of said bale prior to transporting said bale between said upper and lower conveyors, and positioning said upper conveyor based upon said measured height of said bale to adjust the distance between said upper and lower conveyors so that the position of said upper and lower conveyors in relation to each said bale is the same whereby said first and second wrapping sheets are uniformly disposed on said upper and lower surfaces of said bale and the position of the upper sheet in relation to the lower sheet on any given bale is substantially the same.

2. The method of claim 1 including sensing changes in the height of said bales and adjusting the distance between said upper and lower conveyors based upon said changes in said height of said bales.

3. The method of claim 1 wherein said applying of said first wrapping sheet to said lower surface of said bales comprises applying said first wrapping sheet from a lower folding position, and said applying of said second wrapping sheet to said upper surface of said bales comprises applying said second wrapping sheet from an upper folding position.

4. The method of claim 3 wherein said adjusting of said distance between said upper and lower conveyors includes adjusting said upper folding position.

5. The method of claim 1 including synchronizing the speed of said upper and lower conveyors.

6. Apparatus for wrapping a plurality of bales of pulp having various heights comprising an upper conveyor, a lower conveyor juxtaposed with said upper conveyor, whereby said bales may be transported between said upper and lower conveyors in a conveying direction, a transmitter for measuring the height of said bales upstream of said upper and lower conveyors, and positioning means for positioning said upper conveyor based upon the measured height of said bales to adjust the distance between said upper and lower conveyors so that the position of said upper and lower conveyors in relation to each said bale is the same, whereby wrapping sheets may be uniformly disposed on said upper and lower surfaces of said bales as said bales are transported between said upper and lower conveyors and the position of the upper sheet in relation to the lower sheet on any given bale is substantially the same.

7. The apparatus of claim 6 wherein said upper and lower conveyors are substantially parallel to each other.

8. The apparatus of claim 6 including a sensor for measuring changes in said height of said bales.

9. The apparatus of claim 6 including an upper sheet pocket for providing a wrapping sheet to said upper surface of said bales, and a lower sheet pocket for providing a wrapping sheet to said lower surface of said bales, said upper sheet pocket being connected to one of said upper and lower conveyors, whereby said upper sheet pocket is simultaneously adjusted with said adjusting of said distance between said upper and lower conveyors.

10. The apparatus of claim 6 including synchronizing means for synchronizing the speeds of said upper and lower conveyors.

* * * * *